US005974999A

United States Patent [19]

Hansen et al.

[11] Patent Number: 5,974,999

[45] Date of Patent: Nov. 2, 1999

[54] MAST FOOTING FOR A WINDSURFING RIG

[75] Inventors: Reinhard Hansen, Salzburg, Austria; Neil Pryde, Tai Po., The Hong Kong Special Administrative Region of the People's Republic of China

[73] Assignee: Goodwell International, Ltd., Tortola, Virgin Islands (U.S.)

[21] Appl. No.: 08/992,761

[22] Filed: Dec. 11, 1997

[30] Foreign Application Priority Data

Sep. 1, 1997 [DE] Germany ..... 197 38 117

[51] Int. Cl.[6] ..... B63B 15/00

[52] U.S. Cl. ..... 114/93; 114/102.12; 114/109

[58] Field of Search ..... 114/93, 108, 109, 114/113, 102, 39.2, 91, 39.12, 102.12

[56] References Cited

U.S. PATENT DOCUMENTS

| | | | |
|---|---|---|---|
| 4,224,890 | 9/1980 | Johnson, Jr. | 114/109 |
| 4,586,450 | 5/1986 | Bernard | 114/108 |
| 4,773,345 | 9/1988 | Lilliehook | 114/109 |
| 5,239,939 | 8/1993 | Purdy | 114/109 |

FOREIGN PATENT DOCUMENTS

| | | | |
|---|---|---|---|
| 2677946 | 12/1992 | France . | |
| 32 41 165 | 11/1982 | Germany | B63B 15/00 |
| 33 19 823 | 6/1983 | Germany | B63H 9/08 |
| 35 26 464 | 7/1985 | Germany | B63H 9/10 |
| 36 08 401 | 3/1986 | Germany | B63H 9/10 |
| 386 170 | 5/1986 | Germany | B63B 15/00 |
| 36 33 752 | 10/1986 | Germany | B63B 15/00 |
| 37 04 116 | 3/1987 | Germany | B66D 3/02 |
| 90 02 581 | 3/1990 | Germany | B63H 9/10 |
| 59-220490 | 12/1984 | Japan | B63H 9/10 |
| 2 234 729 | 2/1991 | United Kingdom | B63H 9/10 |

OTHER PUBLICATIONS

Surf Magazine, pp. 22–25, Feb. 1988.

*Primary Examiner*—Sherman Basinger
*Attorney, Agent, or Firm*—Senniger, Powers, Leavitt & Roedel

[57] ABSTRACT

A mast footing having a tensioning device for the leading edge with the components which provide for a reduction of force being attached to the mast footing such that they may be detached. When the sail has been correctly trimmed, i.e., with the leading edge tensioned, the device is removed from the arrangement. Then, only a hook-shaped device of short length is attached between a loop at the neck of the sail and a hook at the mast footing, which device preferably has a constant length or, at most, may be fine-tuned within a range of a few centimeters.

21 Claims, 15 Drawing Sheets

MAST FOOTING FOR A WINDSURFING RIG

BACKGROUND OF THE INVENTION

The invention relates to a mast footing for a windsurfing rig having a force reduction device in order to, tension the leading edge of the sail.

A mast footing of this type is disclosed in German Patent DE 3,633,752 C2. There, in order to tension the leading edge, a tensioning device is used which has a rod and a silent ratchet, adjustable in steps, which may be operated by means of a hand lever. The rod and the silent ratchet are arranged in the interior of a tubular mast footing which features a longitudinal slot, which is penetrated by the hand lever. The force required in order to tension the leading edge may be applied effortlessly with the tensioning device. However, the tensioning device for the leading edge has, on the whole, a relatively great weight, which does not achieve weight-saving goals. Today, great efforts are being made to save weight in the area of the rig.

With modern rigs and sails, an optimal tension of the leading edge and the bending of the mast connected therewith is determined, in essence, by means of the cut of the sail and should vary over, at most, only a very limited range in response to the strength of the prevailing wind. Consequently, the range of fine-tuning amounts to only a few centimeters. In this connection, the force which must be applied to the leading edge for an ideal bending curve of the mast lies between 200 kp (1962 N) and 400 kp (3924 N). Yet, most windsurfers fear a mast break, such that in practice, the leading edge is not tensioned adequately and, consequently, windsurfing is undertaken without the sail being optimally trimmed.

Tensioners for the leading edge used by most surfers today consist of a tackle which is reeved fourfold to sixfold, one end of which has a hook which is secured in a loop of the sail and the other end of which is fastened to the mast footing. In addition, a sheet clamp is present at the mast footing, in which the free end of the line of the tackle is loaded. With this stretcher for the leading edge, the problem also occurs that the tensile force required in order optimally to trim the sail can scarcely be applied by one person and that the end of the tackle, part of which is quite long, must be stowed after tensioning, which is commonly carried out by means of winding it about the mast footing or stowing it inside the mast footing.

SUMMARY OF THE INVENTION

The purpose of the invention is to improve the aforementioned mast footing to the effect that it has limited weight during use and, notwithstanding, the tensioning force required for an optimal trimming of the sail is applied with limited effort.

The aforementioned problems are solved by providing a mast footing for a windsurfing rig namely, having a force reduction device in order to tension the leading edge of the sail, wherein the force reduction device is connected to the mast footing such that the former is detachable, and connected to a connecting device, with the connecting device being able to be connected to the sail and to a hook attached to the mast footing and having a length which is essentially constant.

The fundamental principle of the invention is that the essential parts of a tensioning device for the leading edge, and therefore, more specifically, those parts which provide for a reduction of force, are attached to the mast footing in removable fashion. When the sail has been correctly trimmed, i.e., the leading edge has been tensioned, said part of the device is removed. A hook-shaped connecting device of short length is then attached between a loop at the neck of the sail and a hook at the mast footing. It is preferable for the connecting device to have a constant length, or, at most, to be able to be fine-tuned within the range of a few centimeters.

In accordance with a preferred embodiment of the invention, the force-reducing part of a tensioning device for the leading edge consists of an approximately Z-shaped crank rod, which is inserted to be coaxial or transverse to the mast footing and to which a line is fastened, the free end of which is secured in the connecting device. By means of turning the crank rod, the leading edge is tensioned until an eye of the connecting device is securable in a hook at the mast footing. Then the free end of the line is removed from the connecting device and the crank rod pulled out. The crank rod delivers a substantial reduction of force and, consequently, a very high level of tension may be applied with limited effort.

The invention provides different variants in order to bring about a reduction of force, more specifically, a cylindrical or conical winding spindle, a toothing with ratchet drive, a toothing with crank drive, a cam plate, a threaded rod, a block and tackle, a hydraulic pump, a scissors-type assembly resembling a jack, etc. In principle, all known types of force reduction devices may be used. It is important that the force reduction device be able to be removed after the leading edge has been tensioned.

In accordance with a refinement of the invention, a conical winding spindle is attached to the mast footing in order to wind a line connected to the connecting device. A rope drum, on which a traction rope may be wound, may be connected to the winding spindle. By means of pulling on a traction rope, the line is wound onto the winding spindle and consequently tensioned. The rope drum and winding spindle may be arranged on the mast footing to be transverse or coaxial.

In accordance with a further refinement, a reduction of force is carried out by means of a crank drive, accommodated in a housing, in which a gear meshes with a toothed rack to be moved. Alternatively to a toothed rack, a toothed belt may also be used, which works in cooperation with a ratchet.

In accordance with a refinement of the invention, a toothing is attached to the exterior of the mast footing in a longitudinal direction and a reduction of force is realized by means of a sleeve which is slipped onto the mast footing and in which a ratchet lever is supported that engages with the toothing of the mast footing. In order to tension the sail, the sleeve is connected to the sail by means of a connecting device.

In accordance with a refinement of the invention, a housing is slipped onto the mast footing and a threaded rod in the form of a crank is screwed into the housing. Tension force may be applied by means of turning the threaded rod.

In accordance with a refinement of the invention, a housing is slipped onto the mast footing, and a block and tackle is fastened to one end. Alternatively to this, a tackle carrier of the appropriate end of the block and tackle may be secured to the mast footing such that it may be detached. The other end of the block and tackle is connected to the connecting device in order to tension the sail.

In accordance with a refinement of the invention, the mast footing is connected to a cylindrical tensioning device, to which is attached a plate having an eccentric slot. A pin projects into the slot, which pin is connected to the connecting device and which is moved by turning the plate.

In accordance with a refinement of the invention, a housing which contains a hydraulic pump is connected to the mast footing. By means of operating the hydraulic pump, a rod is moved and tension applied by said means.

In accordance with a further refinement of the invention, a plug-in part is slipped onto the mast footing; and parallelogram bars resembling a jack are connected to said plug-in part in order to tension the sail.

Other objects and features of the invention will be in part apparent, and in part described hereafter.

BRIEF DESCRIPTION OF THE DRAWINGS

In the following, the invention is explained in greater detail with the aid of several embodiments, in connection with the drawing. Shown are.

DETAILED DESCRIPTION OF THE INVENTION

Figure 1:
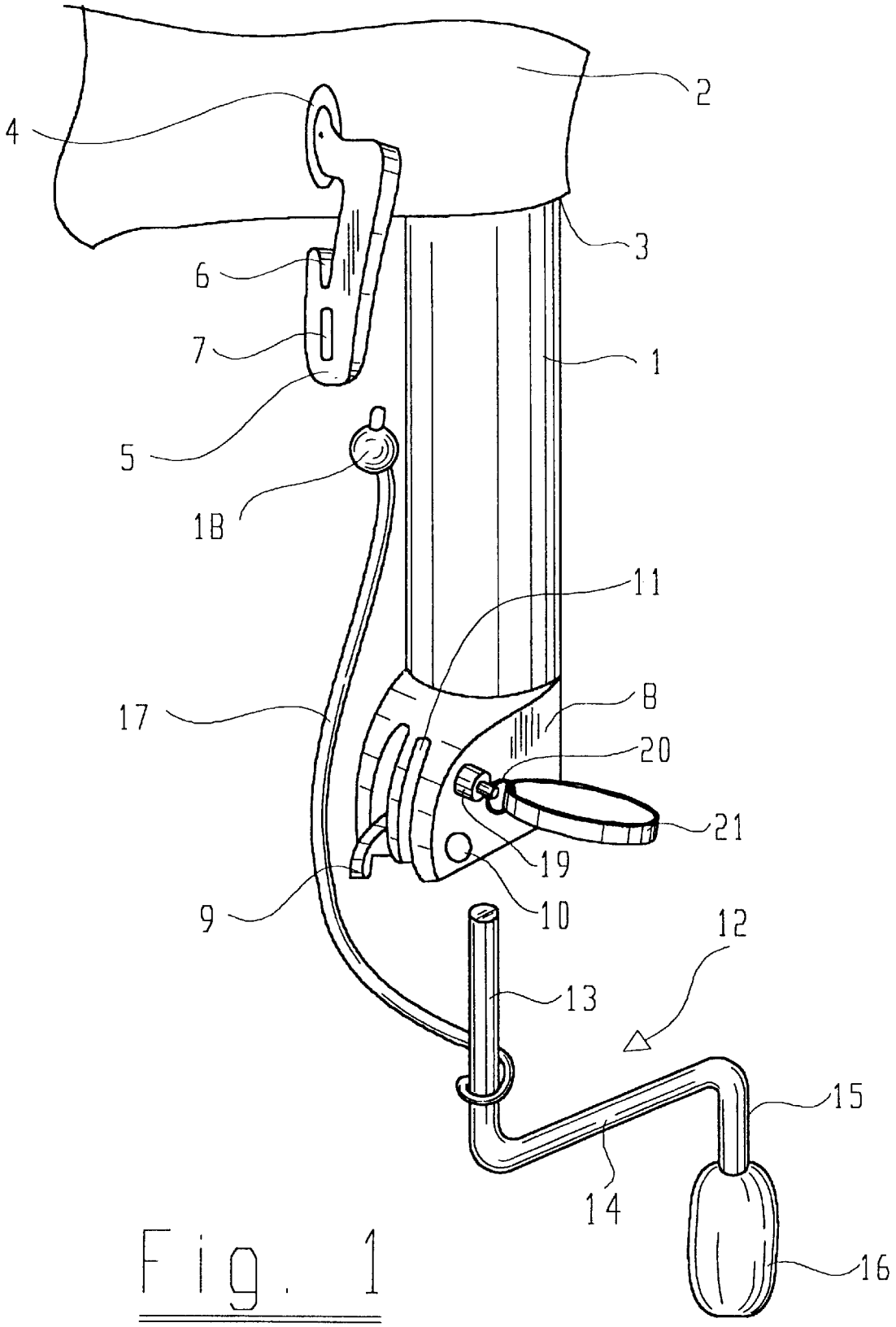
FIG. 1: A mast footing with a tensioning device for the leading edge, having a hand crank.

A mast footing (1) in the form of a cylindrical tube which is inserted in the mast pocket (3) of a sail (2) is shown in FIG. 1. The mast footing (1), in conventional fashion, is connected to the bottom end of the mast (not shown). A loop (4), in which a connecting device (5) is secured, is present on the neck of the sail. The connecting device (5) has a first recess (6) in the form of a hook which opens (upward) toward the foot of the sail (2) and a second recess (7), in the form of a slot which is displaced downward in comparison to the first recess (6). A locking device (8) which features a protruding hook (9), in which the second recess (7) of the connecting device (5) may be secured, is attached to the free bottom end of the mast footing (1). The hook (9) pivots about a shaft (10). A guide (11) in the form of a groove is provided next to the hook (9) in order to lead a tension element line (17). A pulley may also be provided here in lieu of a groove. A force reduction device (12), which here is an essentially Z-shaped crank having three arms (13,14,15) at right angles to each other on a single plane, with a rotating handle (16) being attached to one of the arms (15), provides for the required tension. An arm (13), located parallel to the arm (15), serves, on the one hand, as the turning axis for the crank and, on the other hand, as a winding spindle for a line (17). One end of the line (17) is fastened to the arm (13) and the other end has an enlargement (18), such as a press-on ball, a knot or the like, which is secured in the first recess (6) of the connecting device (5). The arm (13) is introduced into an opening (27) (FIG. 1*f*,1*g*) in the mast footing (1) and the rope (17) is wound onto the arm (13), and consequently tensioned, by means of turning the crank. The length of the center arm (14) in relationship to the diameter of the arm (13) determines the force reduction ratio, which advantageously lies between 1:20 to 1:40. As soon as the rope is somewhat tensioned, it is guided in the guide (11). The crank then is turned until the recess (7) of the connecting device (5) is securable in the hook (9). At this moment, the curvature of the mast and the sail trim are at a given, optimal value. The crank (12) is then loosened somewhat and the line (17) is removed from the first recess (6). The crank (12), including line (17), thereupon is pulled out from the mast footing and set aside.

In order to derig, in this embodiment the hook (9) is detachable, such that it pivots upward about the shaft (10), releasing the connecting device (5). For said fastened, is pulled out, whereupon the hook (9) is released in order to permit a swinging movement upward. If the user wishes to release the tension of the rig more slowly, the user may also reinsert the crank (12) in the mast footing and secure the enlarged end (18) of the line (17) in the recess (6) and, by means of limited amount of additional tensioning, relieve the tension from the hook (9), then pull the locking bolt (19) out at the loop (20), and then, by means of slowly turning the crank (12), relieve the tension on the rig.

It must also be emphasized that when the connecting device (5) is secured in the hook (9), the rig is in an unequivocally defined tensioned position and that the force reduction device is removable from the rig in said state. It burdens the rig neither by means of its weight nor by means of any parts to be accommodated. It is comfortable to operate and is operated with limited expenditure of force, where even a great amount of tension can be applied effortlessly. Finally, the user will apply no more than the possible amount of tension to the leading edge, namely, that which is predetermined by the sail manufacturer, such that mast and sail are always optimally trimmed.

Figure 1E:
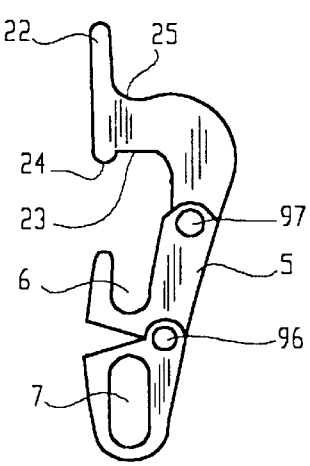
FIGS. 1*b*–1*e*: Side views of additional embodiments of jointed connecting devices.
Figure 1D:
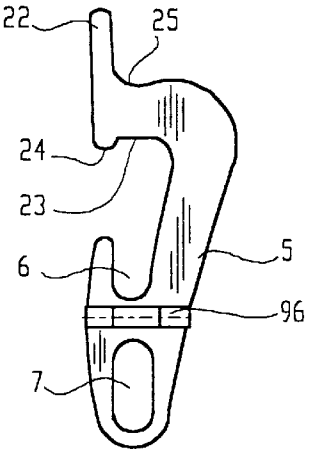
Figure 1C:
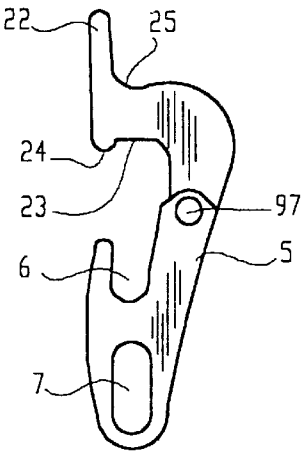
Figure 1B:
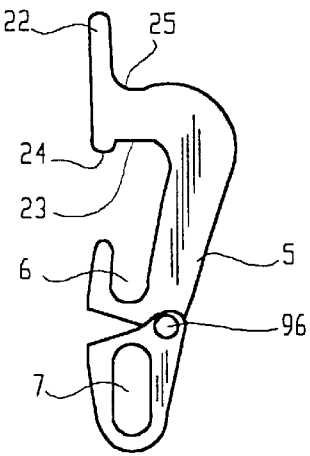
Figure 1A:
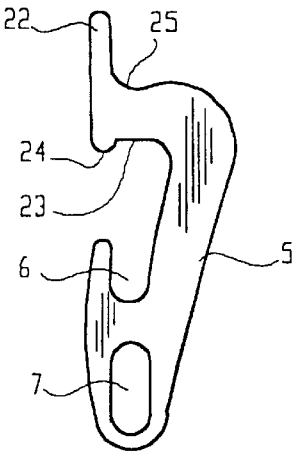
FIG. 1*a*: A side view of a connecting device used in FIG. 1.

FIG. 1*a* shows a side view of a connecting device (5) with a hook-shaped first recess (6) and a second recess (7), here, in the form of a slot. The connecting device (5) also has a platelike securing part (22), which is led through the loop (4) of the sail and is supported against the edge of the loop by means of a rounded section (23). A projection (24) which is joined directly to the rounded section (23) and also the material of the platelike securing part projecting past the contour of the material (25) bordering the rounded section (23) prevent the connecting device (5) from falling out.

As is clear from FIG. 1, the connecting device (5) is aligned in the direction of the tensile force applied by means of the rope (17). Since this tensile force amounts to up to 400 kp (3924 N), with a rigid connecting device (5) it would only be possible for the user to secure the second recess (7) in the hook (9) with great difficulty. Therefore, it is provided to equip the connecting device (5) with at least one drag-link (96), which permits the bottom part of the connecting device (5), which contains the second recess (7), to pivot with respect to the top part, such that the user can readily pivot the bottom part with the second recess (7) and therefore correctly position it with respect to the hook (9), even if a great deal of tensile force is brought to bear by means of the rope secured in the first recess (6). The drag-link (96) optionally has a pivot axis parallel to the direction of passing through the second recess (7) (FIG. 1*b*,1*c*) or also transverse thereto (FIG. 1*d*). It is a further option to equip the connecting device with two joints (96,97) (FIG. 1*e*), in order to, on the one hand, facilitate securing the second recess (7) in the way described and, on the other hand to prevent the top part (22–25) from jamming in the loop (4) of the sail and damaging it by means of the rope secured in the first recess (6). The joint (96) is alternatively in the form of a universal joint.

Figure 1F:
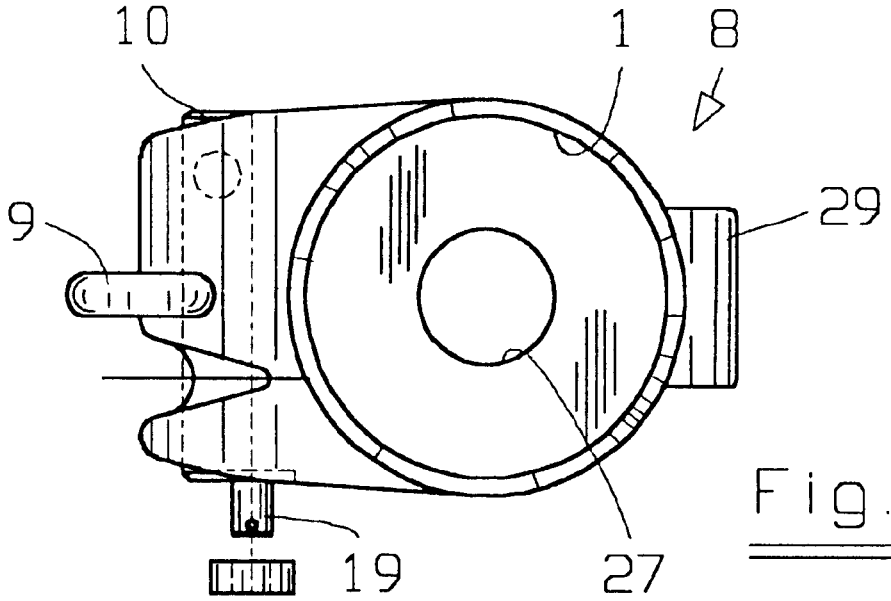
FIGS. 1*f* and 1*g*: A side view and top view of the locking device used in FIG. 1.
Figure 1G:
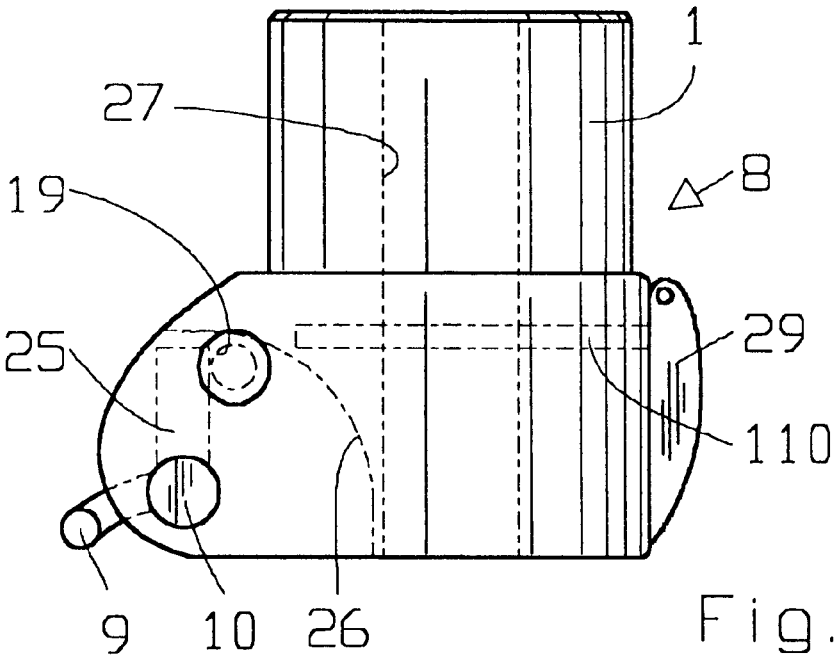

FIGS. 1*f* and 1*g* show, in greater detail, the locking device (8) with hook (9) and shaft (10). In this embodiment, a locking post (25) is provided next to the hook (9) and is positioned approximately perpendicular to the latter, such that when the hook (9) is locked, the locking post is supported against the locking bolt (19) such that the hook (9) cannot be pivoted upward. In contrast, when the bolt (19) is pulled out, then the locking post (25) is released and the hook (9) may pivot upward. A corresponding open space (26) is present in the locking device (8) for the pivoting movement of the post (25). A hole (27) is also to be recognized in the figures, which has a path coaxial to the mast footing (1) and which serves as a bearing for the arm (13) of the crank (12). Also, a connecting bolt (not shown), may be inserted into said hole (27); said bolt connects the mast footing to the universal joint, common in a windsurfer, which, for its part, produces the connection to the surfboard. In order to fasten said fastening bolt, a stay bar (110), which is operated by means of a lever, is provided in the locking device.

Figure 2:
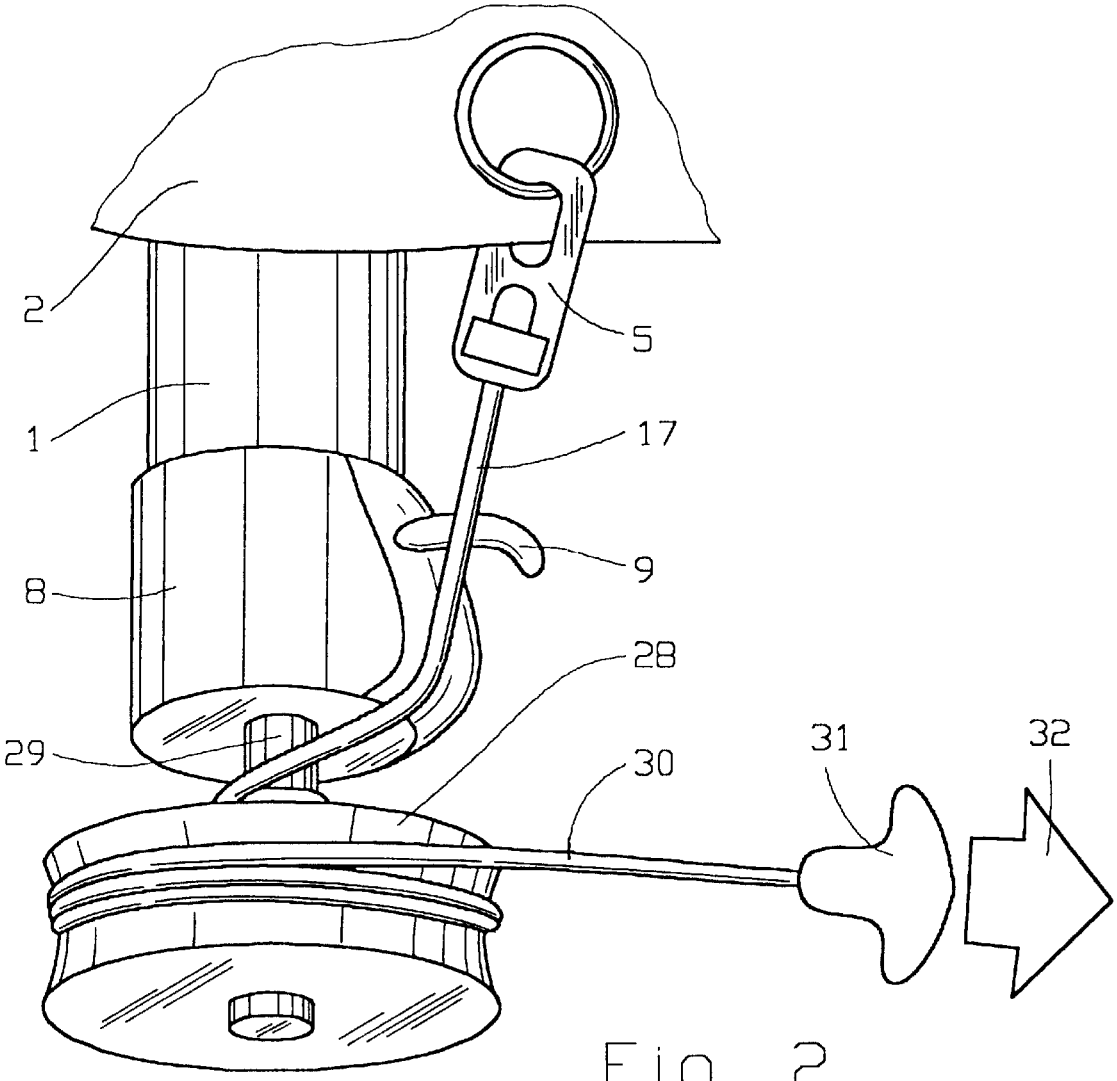
FIG. 2: A perspective view of a mast footing having a tensioning device for the leading edge, in the form of a rope drum with a vertical axis of rotation and a cylindrical winding device.

FIG. 2 shows a variant of the invention in which, in lieu of the crank shown in FIG. 1, a rope drum (28) is used, which possesses a cylindrical winding spindle (29) for winding the rope (17), where said winding spindle (29) simultaneously serves as the axis of rotation for the rope drum (28) and is inserted in the hole (27) (FIGS. 1*a*,1*f*). The diameter of the rope drum (28) is substantially greater than the diameter of the winding spindle (29), with the ratio of said two diameters determining the force reduction ratio of the tensioning device for the leading edge. In order to drive said tensioning device for the leading edge, an additional rope (30) is wound on the rope drum (28) and a free end is fastened to the rope drum (28). The other free end of the rope (30) is provided with a handle (31). When the handle (31) is pulled in the direction of the arrow (32), the rope (17) is wound onto the winding spindle (29) and the leading edge tensioned. After the connecting device (5) has been secured in the hook (9), the winding drum, including ropes (17,30) and winding spindle (29), may be removed.

Figure 3:
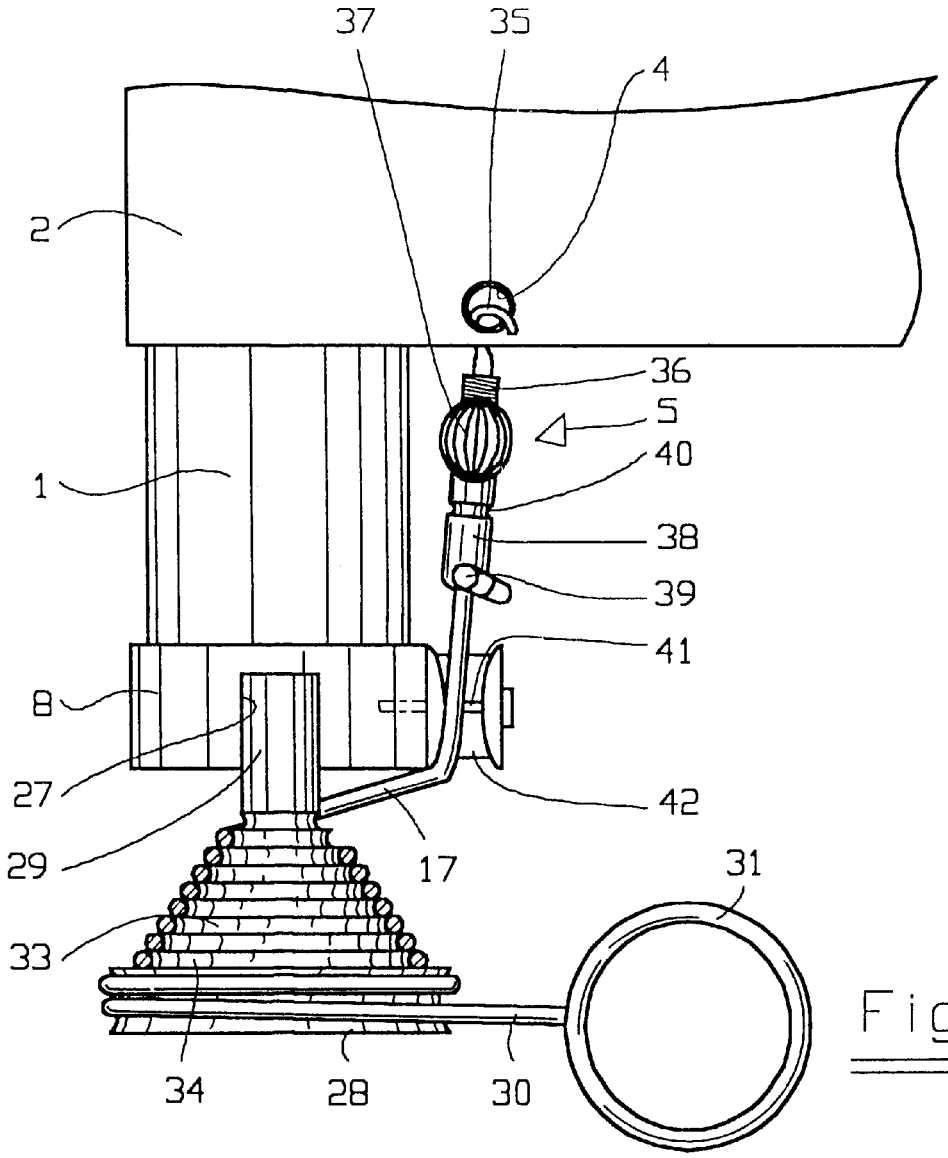
FIG. 3: A mast footing with a tensioning device for the leading edge which has a vertical axis of rotation and conical winding device.

FIG. 3 shows a variant similar to FIG. 2, yet with the measure that the winding spindle features, in the extension of the cylindrical axis of rotation (29), a conical section (33), to which are connected the rope drum (28), rope (30) and handle (31). The cone runs to a point from the rope drum (28) in the direction of the cylindrical axis of rotation (29) such that, at the start, the rope (17) is wound on the part of the conical section having a greater diameter and, with further turning, is wound onto the part having a smaller diameter. By this means, the reduction ratio at the start of turning the rope drum is relatively limited, to up to nearly 1:1, and continues to decrease as the rope (17) is additionally wound, such that the reduction of force increases continuously. Guiding grooves (34) may be provided in the conical section, which provide for a uniform winding of the rope (17).

In addition, FIG. 3 shows another variant in order to fasten the connecting device (5) to the locking device (8). The connecting device has a hook (35) which is secured in the loop (41) of the sail (2). Said hook is connected to a threaded bolt (36) which is screwed into a handle (37) having an internal screw thread. A coupling device (38) stands off from the handle (37); the former features a hole (39) in order to fix the line (17) and a circumferential groove (40), by means of which the connecting device (5) is fixed to the locking device (8) and, in fact, by means of a clamp (41), which may be pushed into the locking device (8) and engages with the circumferential groove (40). In order to lead the line (17) and in order to lock the coupling device, the locking device (8) features a through-opening (42).

Precision trimming may also be carried out by means of turning the handle with respect to the threaded bolt (36).

After fixing the connecting device (5) to the locking device (8), the force reduction device is also removed here.

Figure 4:
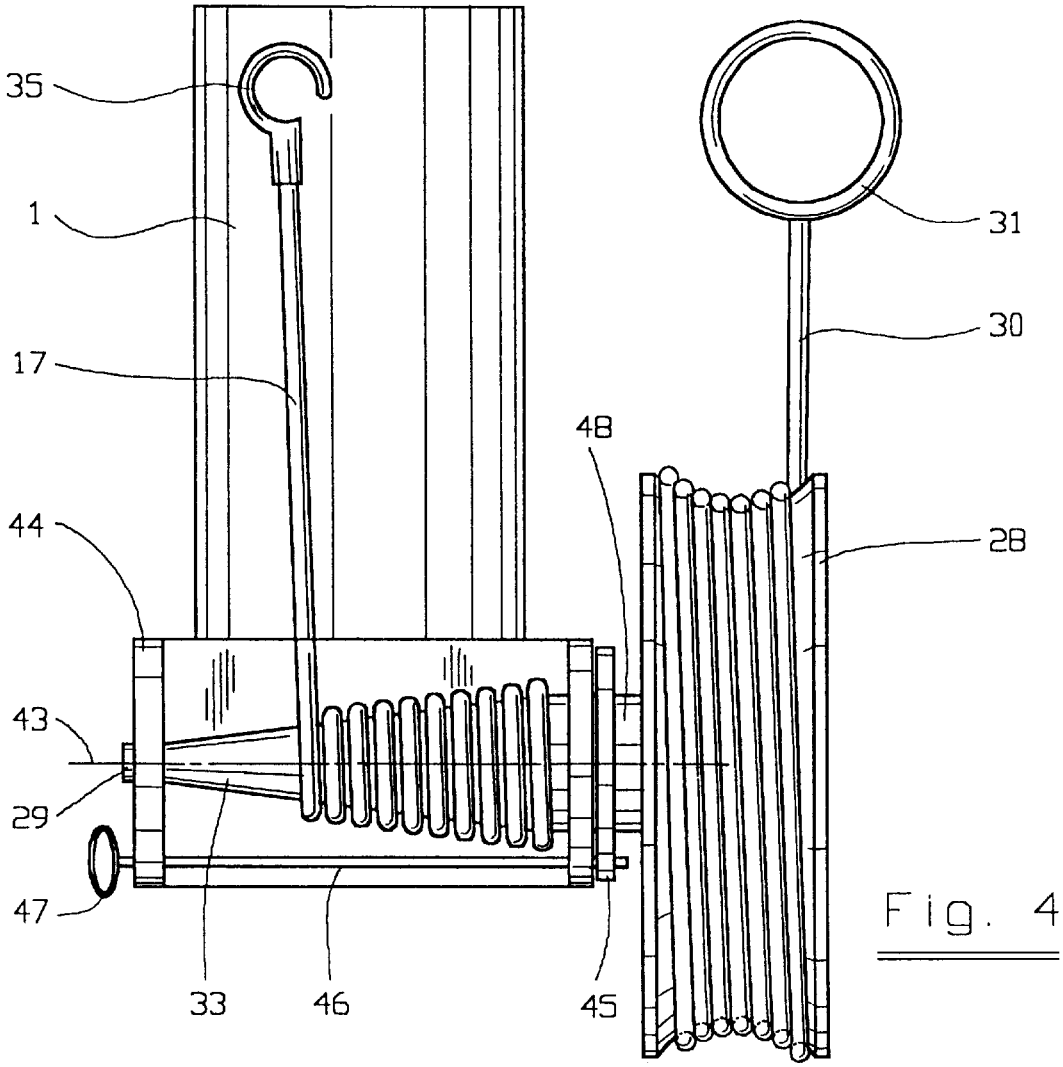
FIG. 4: A mast footing with a tensioning device for the leading edge which has a rope drum with horizontal axis of rotation and a conical winding device.

FIG. 4 shows a modification of the invention, with a rope drum (28), the axis of rotation (43) of which is perpendicular to the central longitudinal axis of the mast footing (1). The winding spindle (29) here also has a conical section (33), upon which the line (17) is wound. The winding spindle is supported in order to be able to rotate in a housing (44), which is rigidly connected to the mast footing (1). A locking plate (45) is rigidly connected to the winding spindle (29); the locking plate has at least one through-hole, through which is led a locking bolt (46) which, for its part, is supported in the housing (44) to be movable in a longitudinal direction and one end of which features a loop handle (47). The rope drum (28) is threaded (not shown) by means of which it is screwed onto one end (48) of the winding spindle and is removed after the mast and sail have been trimmed. The line (17) has a hook (35) by means of which it is fastened to the loop of the sail (not shown) with the line (17) remaining on the rig.

Figure 5:
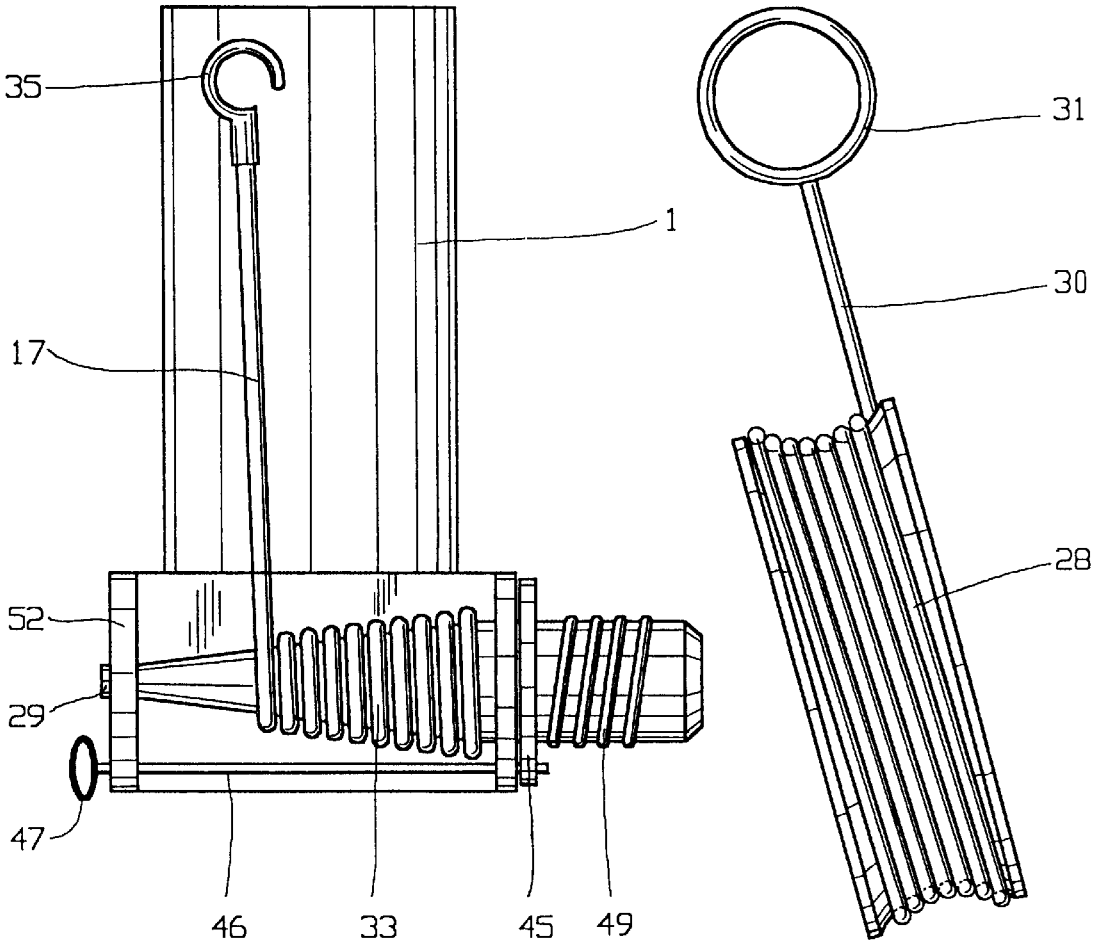
FIG. 5: A view similar to FIG. 4 with rope drum removed.

FIG. 5 clarifies the placement and removal of the rope drum (28) of FIG. 4 on the winding spindle (29) by means of coarse threads (49).

Figure 6:
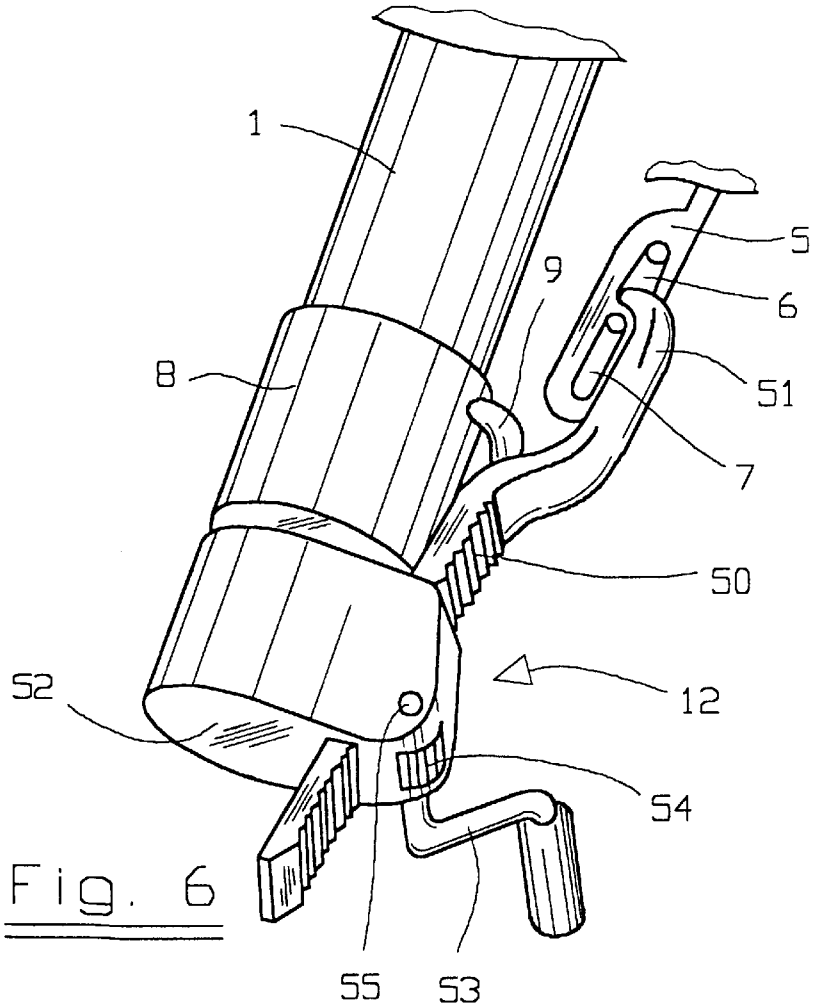
FIG. 6: A mast footing having a tensioning device for the leading edge, in the form of a toothed rack with crank and toothed gear.

FIG. 6 shows another variant of a force reduction device (12), which here consists of a toothed rack (50) having a hook (51) bent at right angles, which is secured in the recess of the hand crank (53) having a toothed gear (54) which engages with the teeth of the toothed rack (50). The crank

(53) is supported in a housing (52) to be able to rotate on a shaft (55). Here also, the connecting device (5) has a second recess (7) by means of which it is secured in the hook (9) and the overall force reduction device (12) may be removed from the mast footing.

Figure 7:
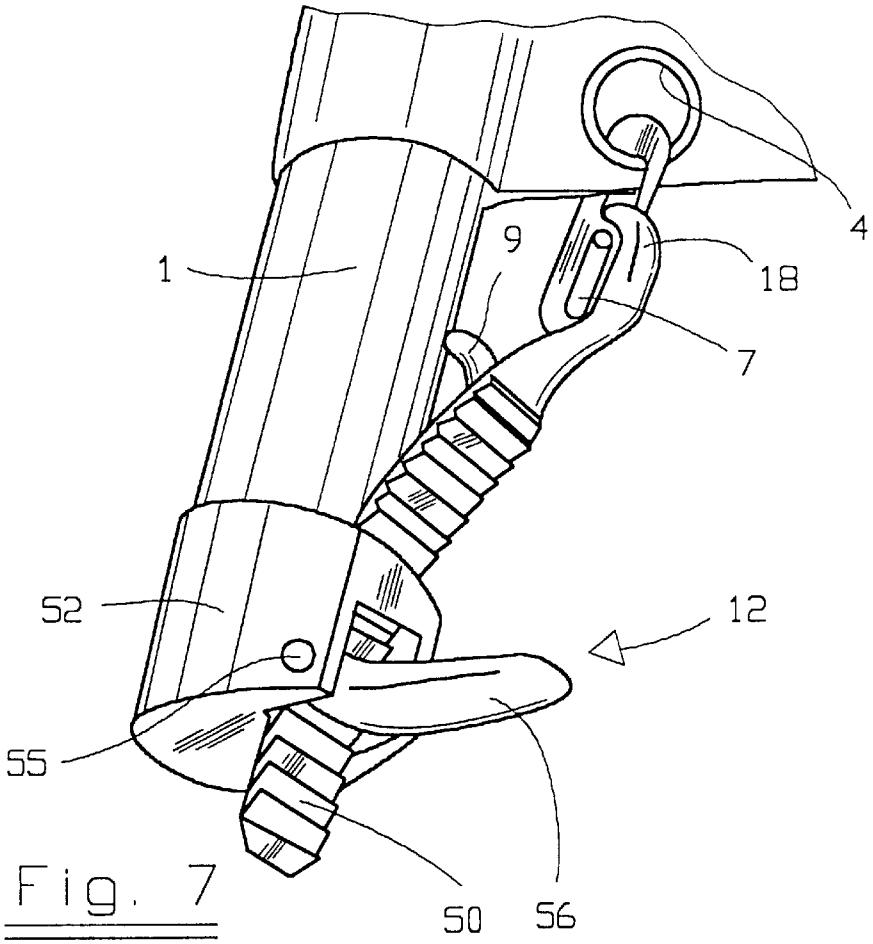
FIG. 7: A mast footing having a tensioning device for the leading edge, in the form of a toothed belt with ratchet drive.

FIG. 7 shows an additional modification of a force reduction device (12), having a toothed belt (50), which is tensioned by means of a ratchet lever (56). The remaining functions correspond to those of FIG. 6.

Figures 8, 9, 10:
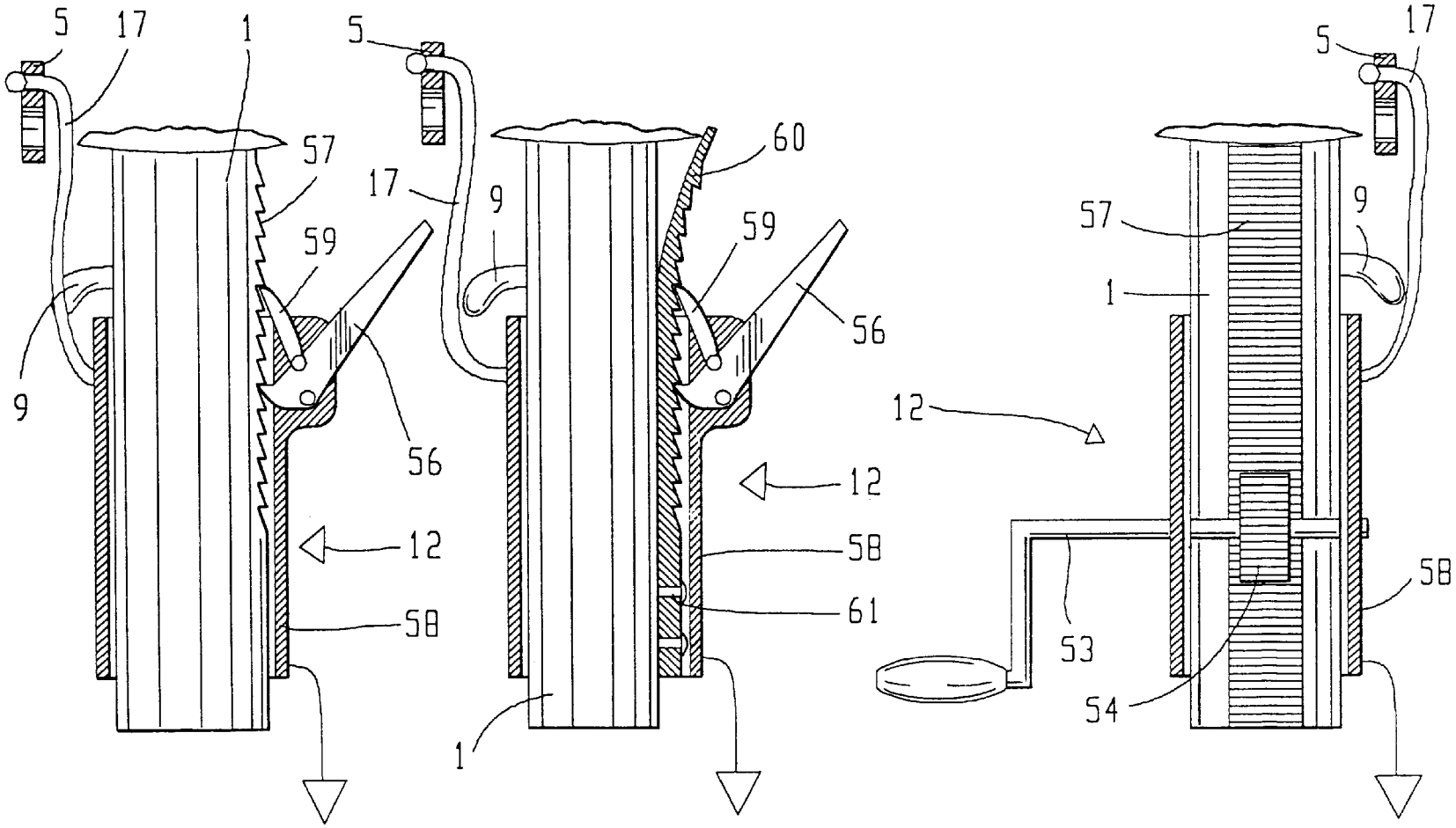
FIG. 8: A schematic sectional figure of a fixed ratchet drive.
FIG. 9: A schematic sectional figure of a second ratchet drive.
FIG. 10: A schematic view of a crank drive with toothed gear and linear toothing.

FIG. 8 shows a modification of a force reduction device (12) with ratchet lever (56). Here, the force reduction device (12) has a sleeve (58) which is slipped over the mast footing (1) and is movable along it. An external toothing (57) having teeth which are sawtoothed is provided on the mast footing (1) in the longitudinal direction of the mast footing. The ratchet lever (56) is pivoted on the sleeve (58). In addition, a detent pawl (59) is pivoted on the sleeve (58) and engages with the teeth of the external toothing (57). In order to tension the rig, the ratchet lever (56) is moved back and forth, which moves the sleeve (58) along the mast footing. A tensioning device (17) is fastened to the sleeve (58) and is coupled to the sail by means of the connecting device (5). Here also, the connecting device (5) likewise is secured in the hook (9) which stands off from the mast footing (1). After securing the connecting device (5) in the hook (9), the overall force reduction device, including ratchet lever (56) and sleeve (58), may be removed from the mast footing.

FIG. 9 shows a similar variant, in which the external toothing is formed by means of a toothed belt (60) which is fastened to the outside of the mast footing (1); said fastening may be carried out, e.g., by means of rivets (61). Otherwise, the embodiment of FIG. 9 corresponds to that of FIG. 8.

FIG. 10 shows an alternative embodiment which has a sleeve (58), which may be moved along an external toothing (57) on the mast footing (1) by means of a crank (53) to which is attached a toothed gear (54). Here also, the overall force reduction device may be removed from the mast footing after the connecting element (5) has been secured in the hook (9).

Figure 11:
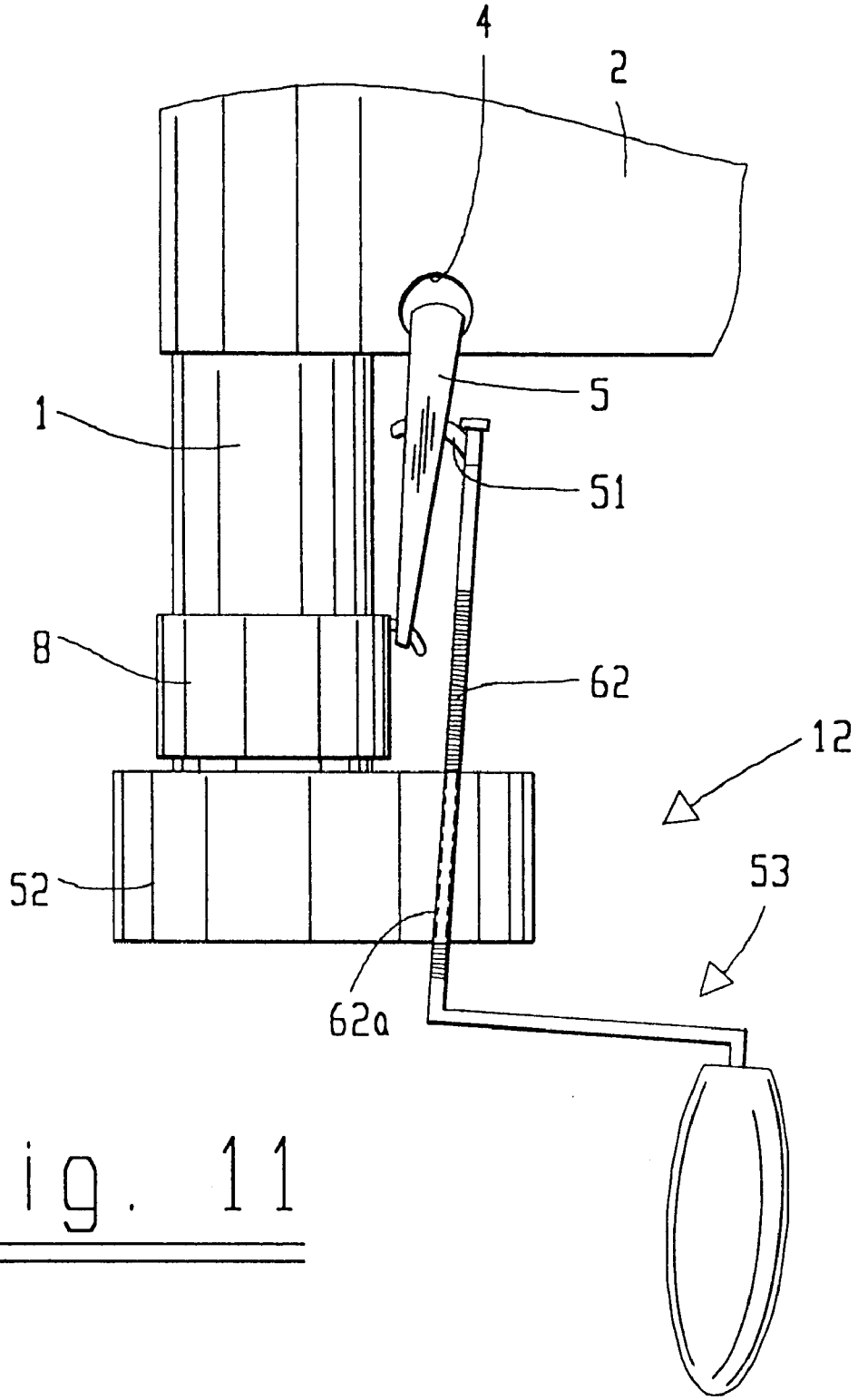
FIG. 11: A mast footing with a tensioning device for the leading edge in the form of threaded rod with crank drive.

In FIG. 11, a force reduction device (12) is formed by means of a threaded rod (62), one end of which has a hook (51) which is hooked into the connecting device (5) and on the other end of which a crank (53) is attached. Threads (62*a*) are provided in the housing (52) so that the threaded rod (62) may be screwed in or out. Here also, the overall force reduction device (12) may be removed from the mast footing (1).

Figure 12:
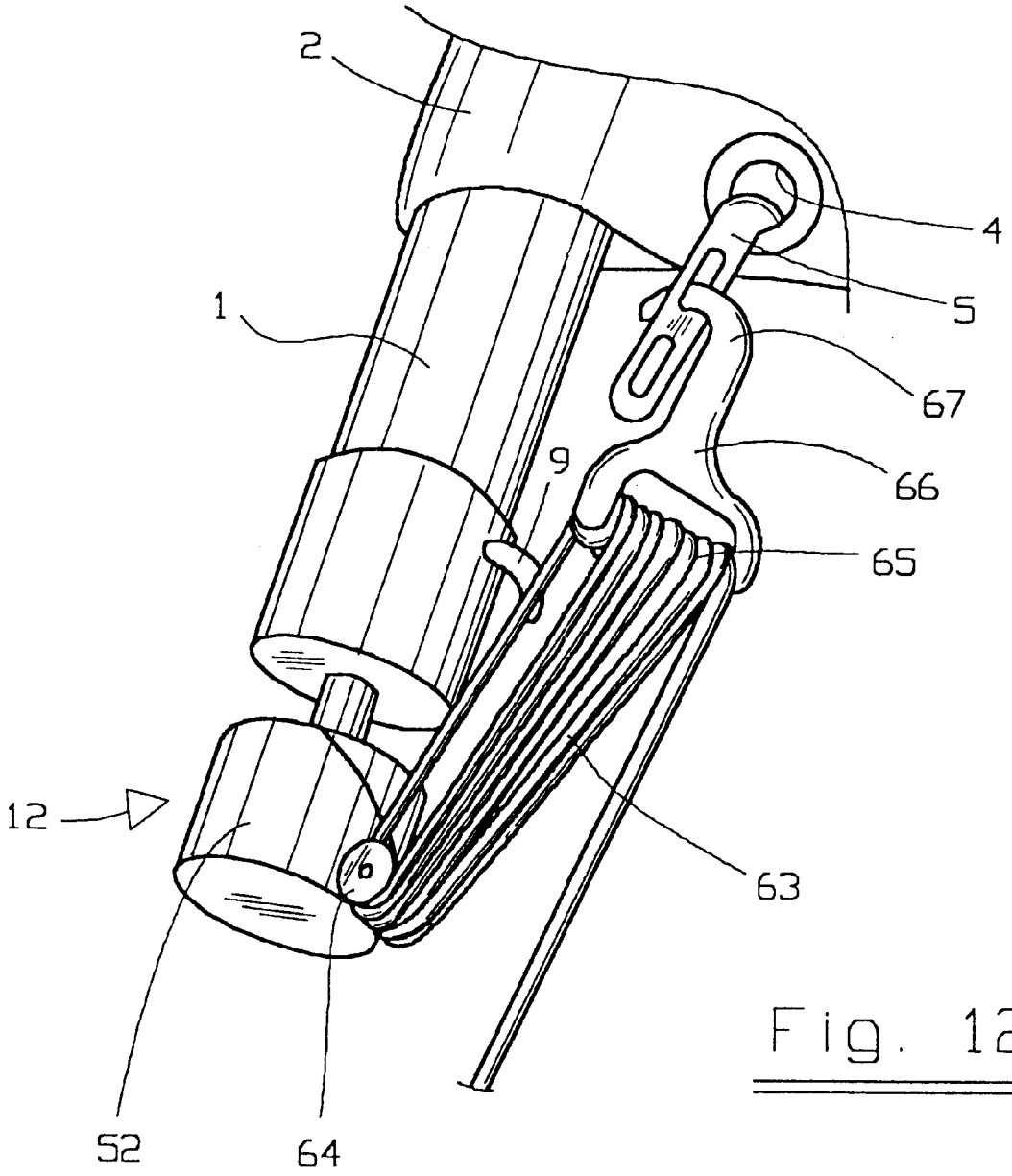
FIG. 12: A mast footing with tensioning device for the leading edge in the form of a block and tackle.

FIG. 12 shows a variant of the invention in which the force reduction device is a block and tackle (63), which may have any given reduction ratio, preferably between 1:6 and 1:10. A number of pulleys (64) are supported to be able to rotate on a housing (52), which may be inserted in the mast footing (1). A corresponding number of additional pulleys (65) is supported to be able to rotate on a stirrup piece (66), with said stirrup piece featuring a hook (67) in order to be able to be secured in the connecting device (5). Here also, the connecting device (5) is secured in a hook (9) fastened to the mast footing and, subsequently, the overall force reduction device (12) is removed from the mast footing. Since with the desired force reduction ratio, the line of the block and tackle has to be quite long it is of considerable advantage that the block and tackle may be removed from the rig, since stowing away said long line on an active surf board would clearly result in practical problems.

Figure 13:
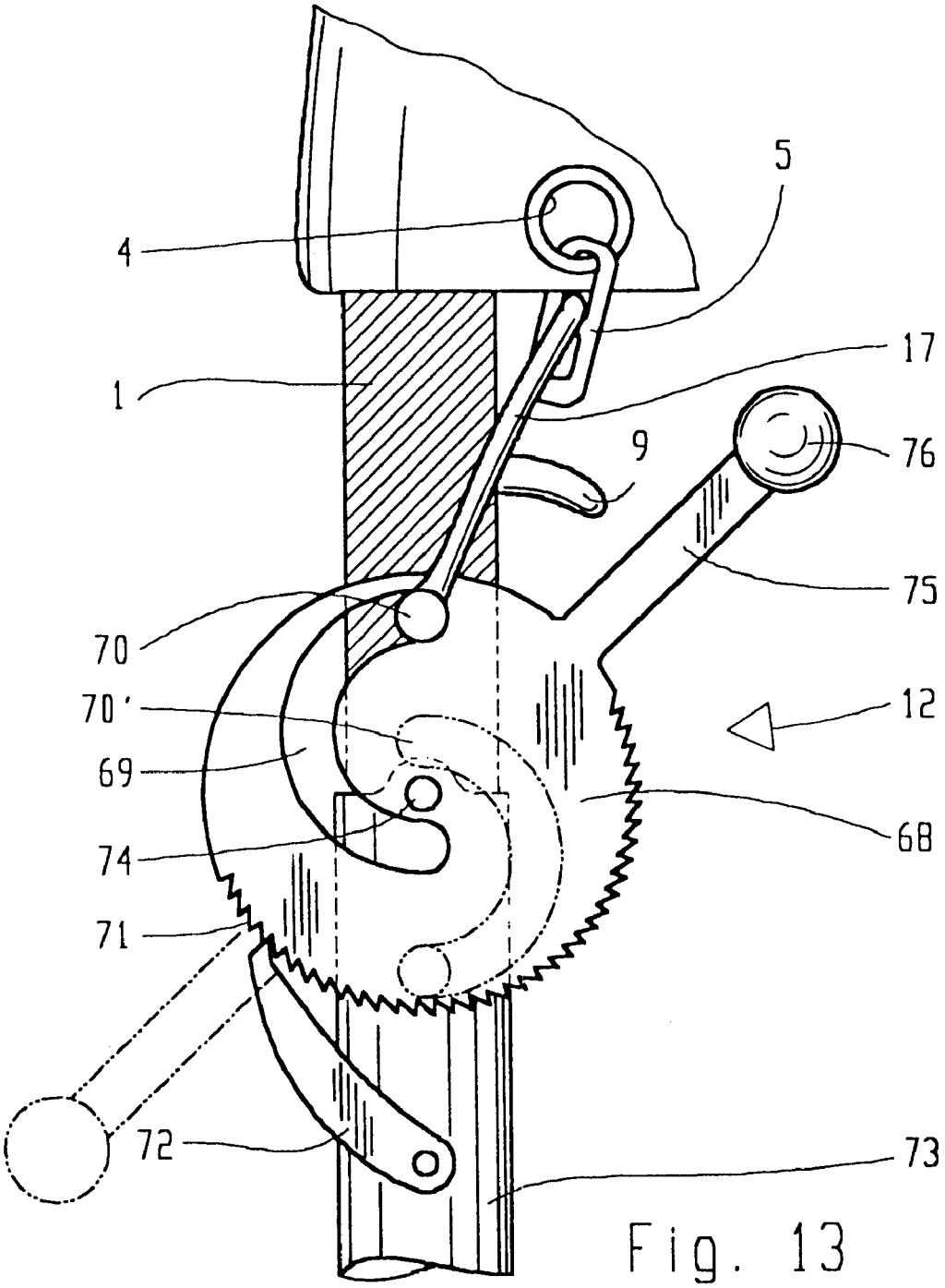
FIG. 13: A diagrammatic representation of a tensioning device for the leading edge in the form of a cam plate with ratchet.

FIG. 13 shows an additional variant of a force reduction device (12) having a rotating plate (68), which features an eccentric slot (69) in which projects a pin (70). The outer circumference of the plate (68) has a toothing (71) with sawtooth teeth, which cooperate with a detent pawl (72). The plate rotates on a device (73) which may be detached from the mast footing (1), while the pin (70) is fastened to the mast footing (1). The mast footing (1) is guided to be movable in the device (73) in telescoping fashion. By means of turning the plate (68), the slot (69) cooperates with the pin (70) as a cam and the pin (70) is moved into the position (70') shown by the dashed line. A rope (17) is fastened to the pin (70) and likewise entrains the connecting device (5), such that it may be secured in the hook (9) attached to the mast footing (1).

Here, in order to turn the plate (68) about the shaft (74), a lever (75) with a handle (76) is attached to the outer circumference of the plate, which lever provides for an adequate reduction of force. Here, the plate is turned by a maximum 180°, corresponding to the shape of the slot. In order to prevent an unintentional "snapping back" of the plate (68) and lever (75), the detent pawl (72) is under prestress in the direction of the plate (68), by means of a spring (not shown).

Figure 14:
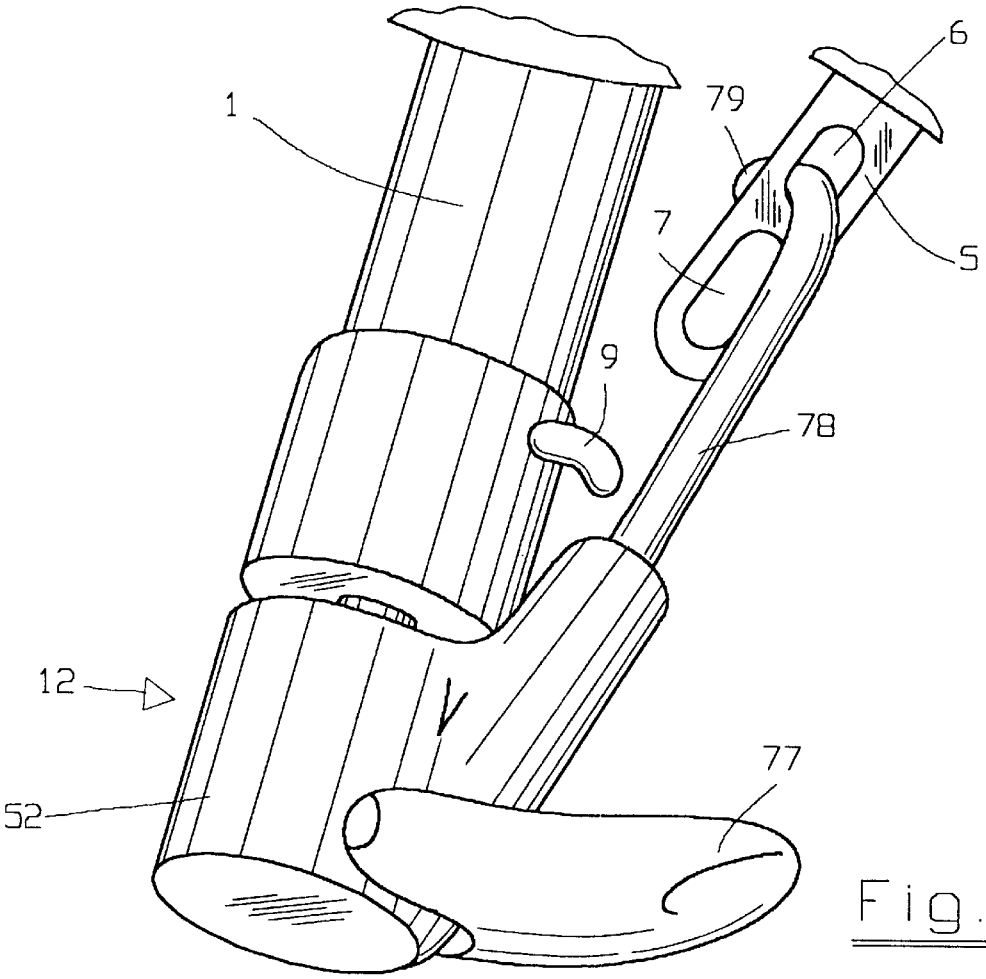
FIG. 14: A mast footing with tensioning device for the leading edge in the form of a hydraulic pump.

FIG. 14 shows an additional variant, in which the force reduction device (12) is a hydraulic pump, which is slipped on the mast footing (1) and which, by means of a lever (77), moves a rod (78) which likewise has an enlarged end (79) by means of which it is secured in the first recess (6) of the connecting device (5). Likewise attached to the mast footing is the hook (9), in which the second recess (7) of the connecting device (5) may be secured. After securing, the overall force reduction device (12) may be removed.

Figure 15:
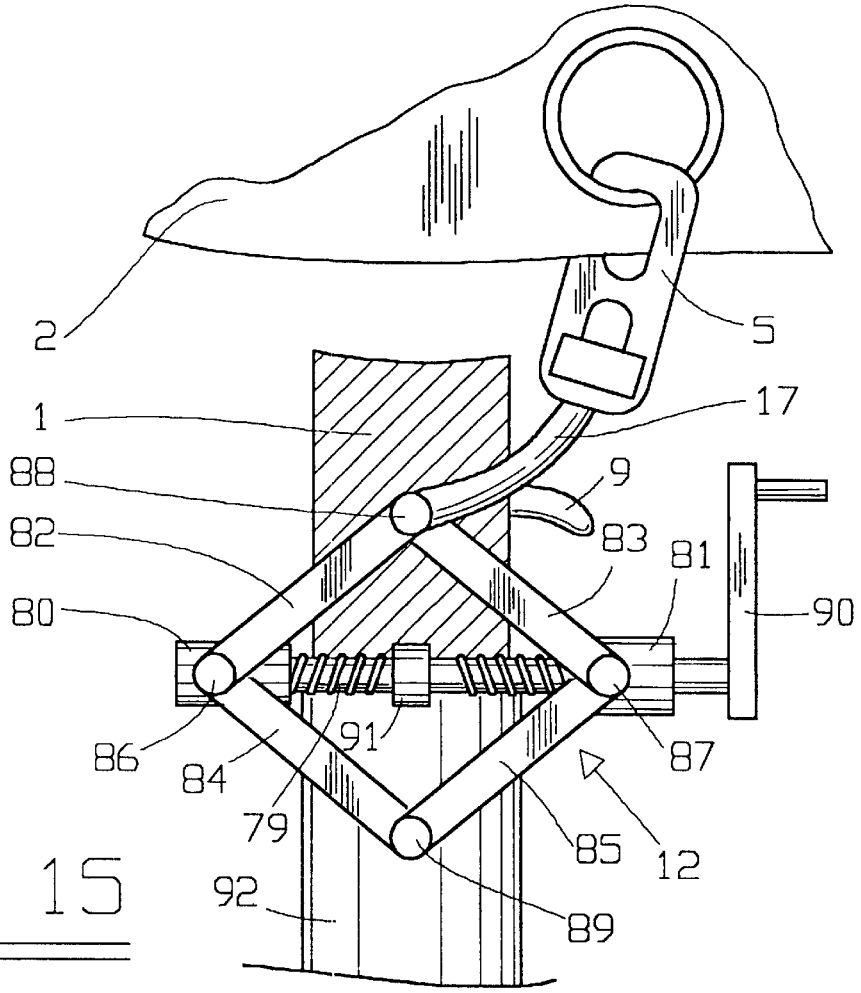
FIG. 15: A diagrammatic representation of a tensioning device for the leading edge with parallelogram rods, threaded rod and crank drive.

FIG. 15 shows an additional variant of a force reduction device (12) which operates in accordance to the principle of a car jack. A threaded rod (79) which, from the center up to one end, features a left-handed thread and, from the center up to the other end, features a right-handed thread, and has, at both ends, one block respectively (80,81) with a corresponding thread, with both blocks (80,81) being connected to each other by means of parallelogram rods (82–85). The individual rods (82–85) are, in each case, in an articulated connection with the adjacent rods and, in fact, in the block (80) the rods (82,84) are connected by means of a joint (86), and in the block (81) the rods (83,85) are connected to each other by means of a joint (87). In addition, the rods (82,83) are connected to each other by means of a joint (88) and the rods (84,85) are connected to each other by means of a joint (89). Beyond the block (81), the threaded rod (79) is connected to a crank (90). By means of a bearing block (91), the threaded rod (79) is connected to a slip on part (92) and supported on the latter such that it may rotate, with said slip-on part (92) being able to be slipped onto the mast footing (1) and removed from it, with the mast footing (1) likewise featuring a hook (9). The line (17) is fastened to the connecting device (5) at the joint (88). By means of turning the crank and, consequently, the threaded rod (79), the joint (88) is moved upward or downward, by means of which the leading edge may be tensioned or detensioned. Here also, after securing the connecting device (5) in the hook (9), the overall force reduction device (12) is removed.

Figure 17:
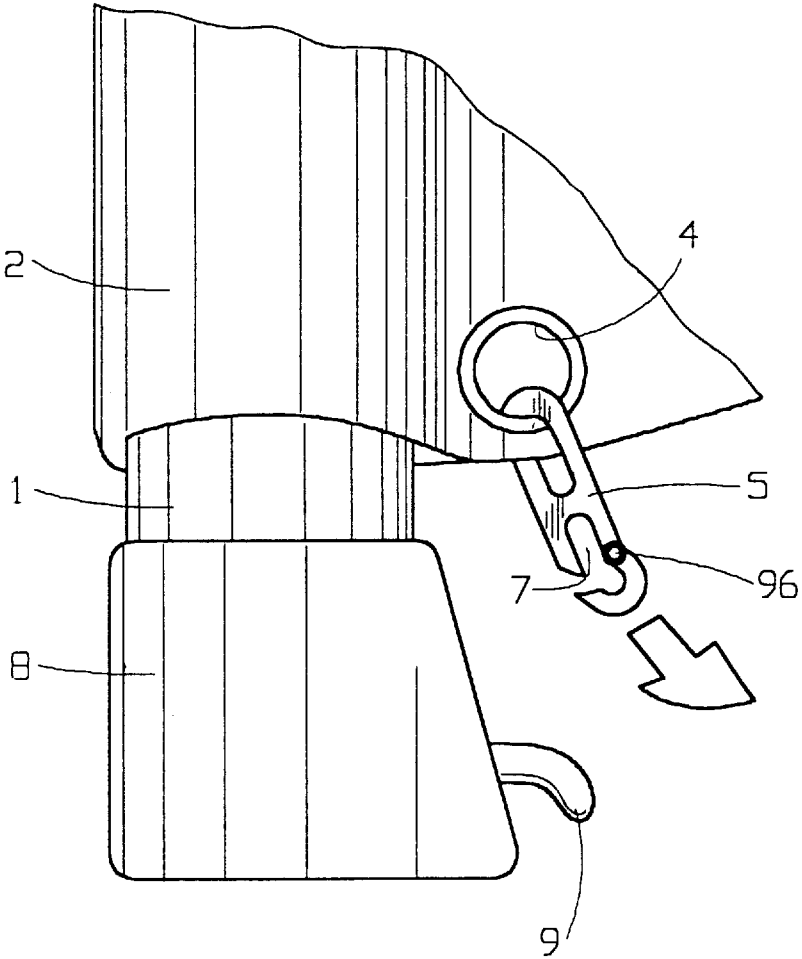
FIG. 17: A diagrammatic representation of a mast footing with connecting device which may be disclosed.
Figure 16:
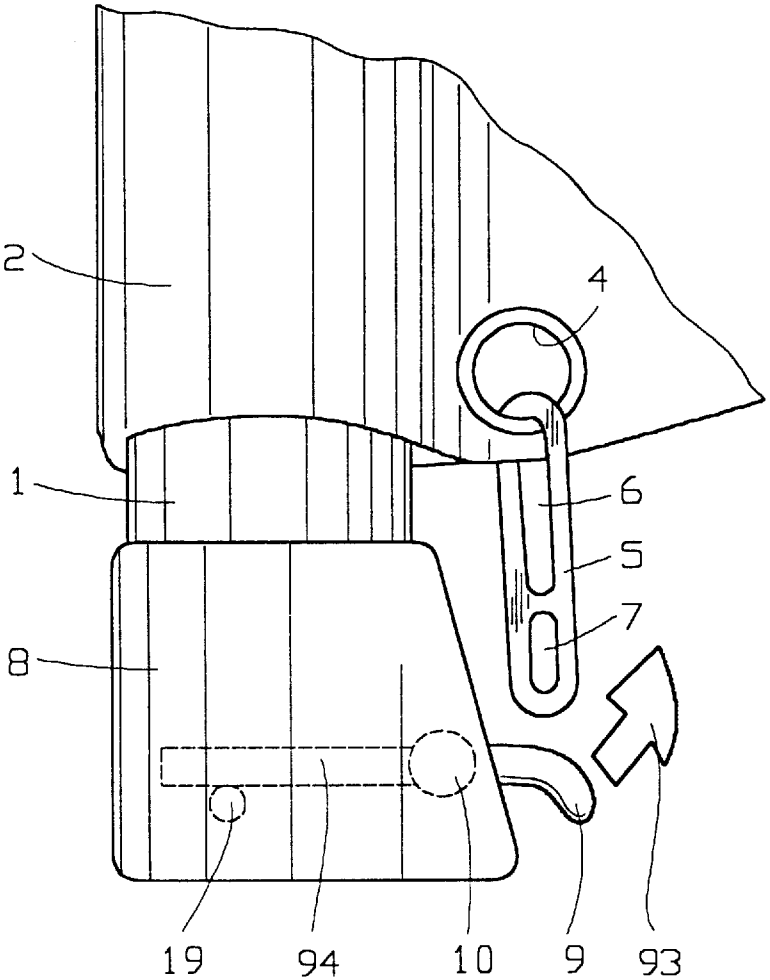
FIG. 16: A schematic side view of a mast footing with hook which may be disclosed.

FIGS. 16 and 17 show two sketches of the principle for detaching the connecting device (5) from the hook (9). In FIG. 16, the hook pivots, as indicated by means of the arrow (93). It possesses, analogously to the embodiment of FIG. 1, a lengthening arm (94) which is supported against the bolt (20). When the bolt (19) is pulled out, the hook (9) may be pivoted upward about the axis (10), releasing the connecting device (5) by said means.

In the variant of FIG. 17, the hook (9) is fastened without play to the locking device (8) or directly to the mast footing (1). The connecting device (5) in the form of a so-called snap-shackle is equipped with a joint (95) in order to open a bottom section (96) in such a way that the second recess (7) is opened and, by said means, the hook (9) released.

Basically, both principles of FIGS. 16 and 17 may be used. The connecting device may also have one or two drag-links in accordance with FIGS. 1*b*–1*e*.

As various changes could be made in the above embodiments without departing from the scope of the invention, it is intended that all matter contained in the above description shall be interpreted as illustrative and not in a limiting sense.

What is claimed is:

1. A mast footing for a windsurfing rig having a force reduction means for tensioning the leading edge of a sail with a mechanical advantage such that force required is reduced, wherein the force reduction means is connected to the mast footing such that the force reduction means is detachable and wherein the force reduction means is connectable to a connector, with the connector connectable to the sail and to a hook attached to the mast footing, the connector having a length which is essentially constant, the hook being pivotable relative to the mast footing and lockable in position.

2. The mast footing of claim 1 wherein the connector is openable.

3. The mast footing of claim 1 wherein the connector is formed by means of at least two parts which are connected to each other by means of at least one joint such that they are pivotable, with at least one of said parts having a recess.

4. The mast footing of claim 3 wherein a pivot axis of at least one joint is transverse to at least one recess.

5. The mast footing of claim 3 wherein a pivot axis of at least one joint is parallel to at least one recess.

6. The mast footing of claim 5 wherein the force reduction means has a winding spindle associated with the force reduction means, which winding spindle has a conical section.

7. The mast footing of claim 6 wherein the conical section features guiding grooves in order to lead a line to be wound up.

8. The mast footing of claim 6 wherein the force reduction means is formed by means of a toothed gear which meshes with a toothed rack and is connected to a crank.

9. The mast footing of claim 5 wherein the force reduction means comprises a toothed belt and a meshing ratchet lever.

10. The mast footing of claim 1 wherein the force reduction means is a crank onto which a line may be wound, and which crank is insertable into the mast footing.

11. The mast footing of claim 1 wherein the force reduction means has a rope drum having an axis of rotation which is coaxial with the mast footing.

12. The mast footing of claim 11 wherein the rope drum is attachable onto a winding spindle by screw attachment, the winding spindle being rotatable on the mast footing.

13. The mast footing of claim 1 wherein the force reduction means is a rope drum having an axis of rotation which is transverse to the mast footing.

14. The mast footing of claim 1 wherein an external toothing is provided on the mast footing in a longitudinal direction and the force reduction means comprises a sleeve which encloses the mast footing, a ratchet lever arranged to be pivotable on the sleeve, and a detent pawl connected to the ratchet lever, with the sleeve being connected to the connector and the ratchet lever and detent pawl being lockable into place in the external toothing.

15. The mast footing of claim 1 wherein the force reduction means is formed by means of a threaded rod screwed into a housing and the housing is mountable on the mast footing.

16. The mast footing of claim 1 wherein the force reduction means comprises a block and tackle having first pulleys supported such that they are rotatable on a housing which is insertable in the mast footing and second pulleys supported such that they are rotatable on a yoke element connected to the connector.

17. The mast footing of claim 1 wherein the force reduction means comprises a block and tackle having first pulleys fastened to the mast footing such that they are detachable and second pulleys supported such that they are rotatable on a yoke element connected to the connector.

18. The mast footing of claim 1 wherein the force reduction means comprises a plate which is supported on a tensioning device such that it is turnable, the tensioning device being connectable to the mast footing, and the plate having an eccentric slot into which projects a pin which is connectable to the connector.

19. The mast footing of claim 1 wherein the force reduction means comprises a hydraulic pump, which may be slipped on the mast footing, which pump moves a rod which is connectable to the connector.

20. The mast footing of claim 1 wherein the force reduction means comprises a plurality of parallelogram rods, with two opposing joints of the parallelogram rods being connected to a first block and a second block, respectively, and each block being screwed onto a threaded rod which, in the region of the first block features right-handed threads and, in the region of the second block features left-handed threads, with the threaded rod being supported such that it is rotatable on a plug-in part connected to the mast footing, and a third joint of the parallelogram rods being connectable to the connector.

21. A mast footing for a windsurfing rig comprising:

a force reduction means for tensioning the leading edge of a sail with a mechanical advantage such that force required is reduced;

wherein the force reduction means is detachably connected to the mast footing;

wherein the force reduction means is connectable to a connector;

wherein the connector is connectable to the sail and to a hook attached to the mast footing, which connector has a length which is essentially constant; and wherein the hook is pivotable relative to the mast footing and lockable in position.

* * * * *